US006461146B1

(12) United States Patent
Hu

(10) Patent No.: US 6,461,146 B1
(45) Date of Patent: Oct. 8, 2002

(54) ADJUSTABLE JET FLAME UTILITY LIGHTER

(75) Inventor: Yong Yuan Hu, South El Monte, CA (US)

(73) Assignee: Zreative Product Inc., El Monte, CA (US)

( * ) Notice: Subject to any disclaimer, the term of this patent is extended or adjusted under 35 U.S.C. 154(b) by 0 days.

(21) Appl. No.: 09/714,562

(22) Filed: Nov. 17, 2000

(51) Int. Cl.[7] ..... F23D 11/36; F23Q 7/12
(52) U.S. Cl. ..... 431/153; 431/255; 431/344
(58) Field of Search ..... 431/153, 144, 431/255, 344, 127, 128, 12, 254

(56) References Cited

U.S. PATENT DOCUMENTS 3,493,313 A * 2/1970 Schlamp ..... 431/255
3,922,139 A * 11/1975 Sugawa ..... 431/344
4,069,006 A * 1/1978 Jackson ..... 431/344
4,526,532 A * 7/1985 Nelson ..... 431/255
4,538,984 A * 9/1985 Nakagawa ..... 431/255
5,055,034 A * 10/1991 Wang ..... 431/255
5,667,377 A * 9/1997 Lin ..... 431/344

FOREIGN PATENT DOCUMENTS

FR 2 275 733 A * 2/1976

* cited by examiner

*Primary Examiner*—Henry Bennett
*Assistant Examiner*—Josiah C. Cocks
(74) *Attorney, Agent, or Firm*—Raymond Y. Chan; David and Raymond Patent Group

(57) ABSTRACT

An adjustable jet flame utility lighter includes a hand operative adjustable button rotatably mounted on a casing of the lighter for controlling the flow of gas through a gas emitting nozzle and a holding means mounted on the casing for holding a depressed pusher button in such a manner the lighter is kept in an ignition position. The holding means includes a guiding through channel provided at a bottom of the casing aligning with the pusher button and a holding element movably held with the guiding through channel in such a manner the holding element is arranged to mount on a ceiling of the pusher button so as to retain the lighter in the ignition position. At the same time when the lighter is in use, a user is able to adjust the size of the torching flame by rotating the hand operative adjustable button.

12 Claims, 4 Drawing Sheets

ADJUSTABLE JET FLAME UTILITY LIGHTER

BACKGROUND OF THE PRESENT INVENTION

1. Field of Invention

The present invention relates to jet flame lighter, and more particularly to an adjustable jet flame utility lighter that can keep the lighter in an ignition position for torching utility such as minor soldering.

2. Description of Related Arts

Nowadays, most lighters are used for lighting a cigarette. Like disposable lighter, people mainly use for lighting the cigarette since the flame of the disposable lighter is weak that can only enough to light things such as cigarettes or a candles. So, piezoelectric lighters become popular since the piezoelectric lighters are easy to ignite and clean. Some piezoelectric lighters also provide a windproof feature that the flame of the lighters is strong enough to prevent an unwanted extinguishing of the lighter. So, the piezoelectric lighter is good enough for daily use.

However, when a user wants to do some minor fire work such as minor soldering, the piezoelectric lighter is not strong enough to melt the metal especially an alloy. In order to do the minor soldering, a torch lighter is normally used since the torch lighter provides a strong torching flame for melting the metal.

The torch lighter, such as a standard lighter, comprises a trigger button wherein in order to ignite the torch lighter, a pushing force must be applied on the trigger button. As we know that during soldering, the torch lighter may need to keep in an ignition position for a period of time such that the user must keep applying the pushing force on the trigger button until the soldering work is done. It is inconvenient and unreasonable that the user has to hold the trigger button for a long time. Thus, it is dangerous when the trigger button is positioned close to a gas emitting nozzle since the flame of the lighter is hot and strong, it may burn user's thumb accidentally while keep pressing down the trigger button.

Moreover, the torch lighter comprises a flame regulator encircled the gas emitting nozzle for controlling the flow of gas through the gas emitting nozzle. The user is hard to adjust the flame of the lighter during soldering such that he or she may need to pre-adjust the size of the flame with his or her experience before the use of torch lighter. Even though users can use the conventional torch lighter to do the minor soldering, they are usually refusing to use the lighter because the lighter has lots of drawbacks in practical use.

SUMMARY OF THE PRESENT INVENTION

A main object of the present invention is to provide an adjustable jet flame utility lighter wherein the torching flame from the lighter is strong enough to finish a minor soldering work.

Another object of the present invention is to provide an adjustable jet flame utility lighter comprising a holding means for keeping the lighter in an ignition position. In other words, a user's thumb does not need to keep pressing the pusher button in order to keep the lighter in the ignition position which is safety and convenient.

Another object of the present invention is to provide an adjustable jet flame utility lighter wherein an enlarged hand operative adjustable button is rotatably mounted on the casing such that the user is able to adjust the size of the flame anytime even the lighter is in the ignition position.

Another object of the present invention is to provide an adjustable jet flame utility lighter which does not require to alter the original structural design of the lighter, so as to minimize the manufacturing cost of incorporating the holding means with every conventional lighter having a pusher button.

In order to accomplish the above objects, the present invention provides an adjustable jet flame utility lighter, comprising:

- a casing having a liquefied gas storage,
- a gas emitting nozzle appearing at a ceiling of the casing and communicating with the liquefied gas storage in the casing,
- a piezoelectric unit, which is disposed in the casing for generating piezoelectricity, comprising a movable operating part extended upwardly and an igniting tip extended adjacent to the gas emitting nozzle, wherein when the movable operating part is depressed downwardly, the ignition tip generates sparks to ignite the gas emitted from the gas emitting nozzle at the same time,
- a pusher button slidably mounted on the ceiling of the casing in a vertically movable manner wherein the pusher button is attached to a top of the piezoelectric unit and arranged in such a manner that when the pusher button is depressed downwardly, the movable operating part of the piezoelectric unit is depressed to ignite the lighter,
- a hand operative adjustable button rotatably mounted on the casing for controlling the flow of gas through the gas emitting nozzle, and
- a holding means mounted on the casing for holding the depressed pusher button in such a manner the lighter is kept in an ignition position.

DETAILED DESCRIPTION OF THE PREFERRED EMBODIMENT

Figure 1:
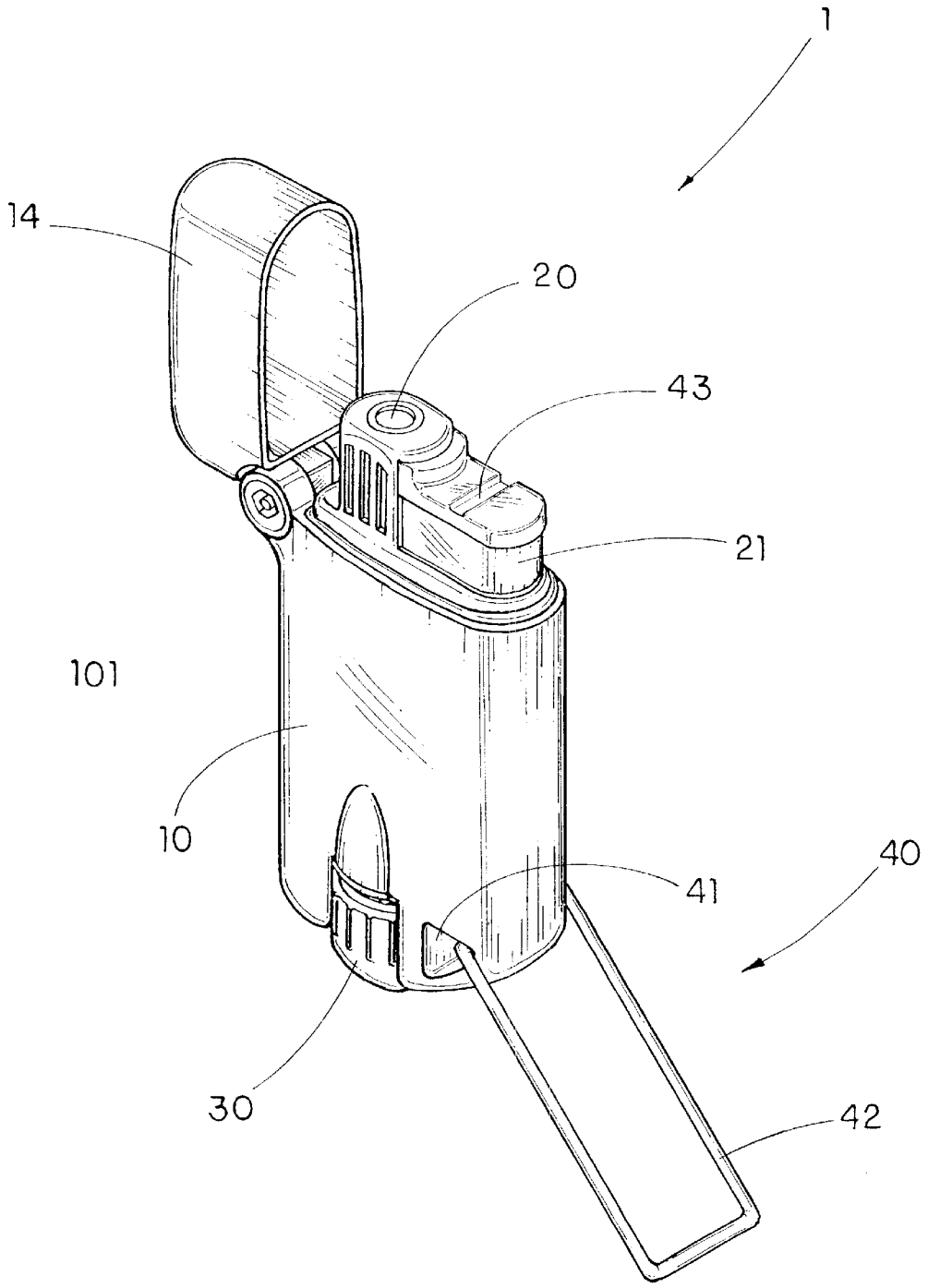
FIG. 1 is a perspective view of an adjustable jet flame utility lighter according to a preferred embodiment of the present invention.
Figure 2:
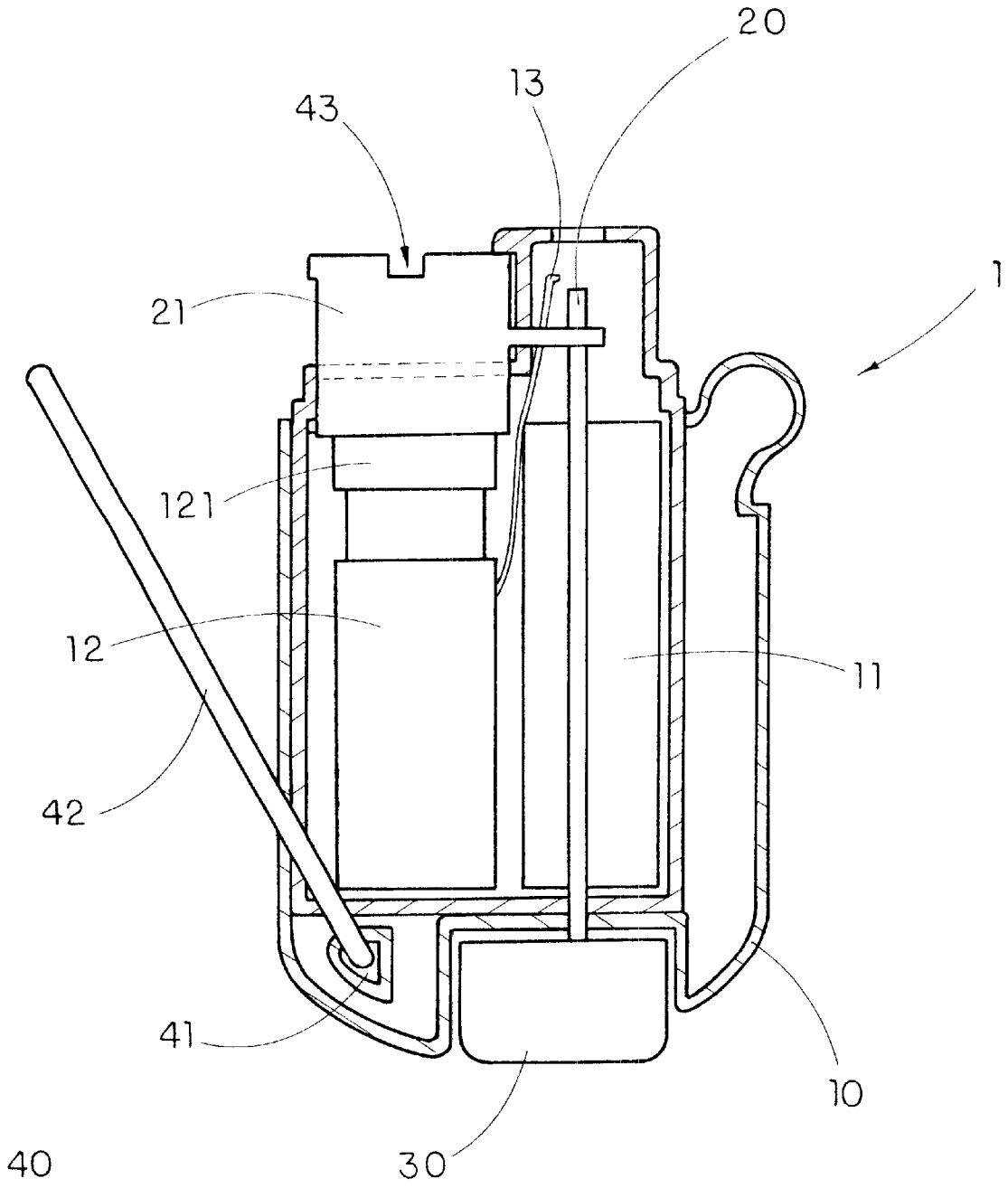
FIG. 2 is a sectional view of the adjustable jet flame utility lighter according to the above preferred embodiment of the present invention.
Figure 3:
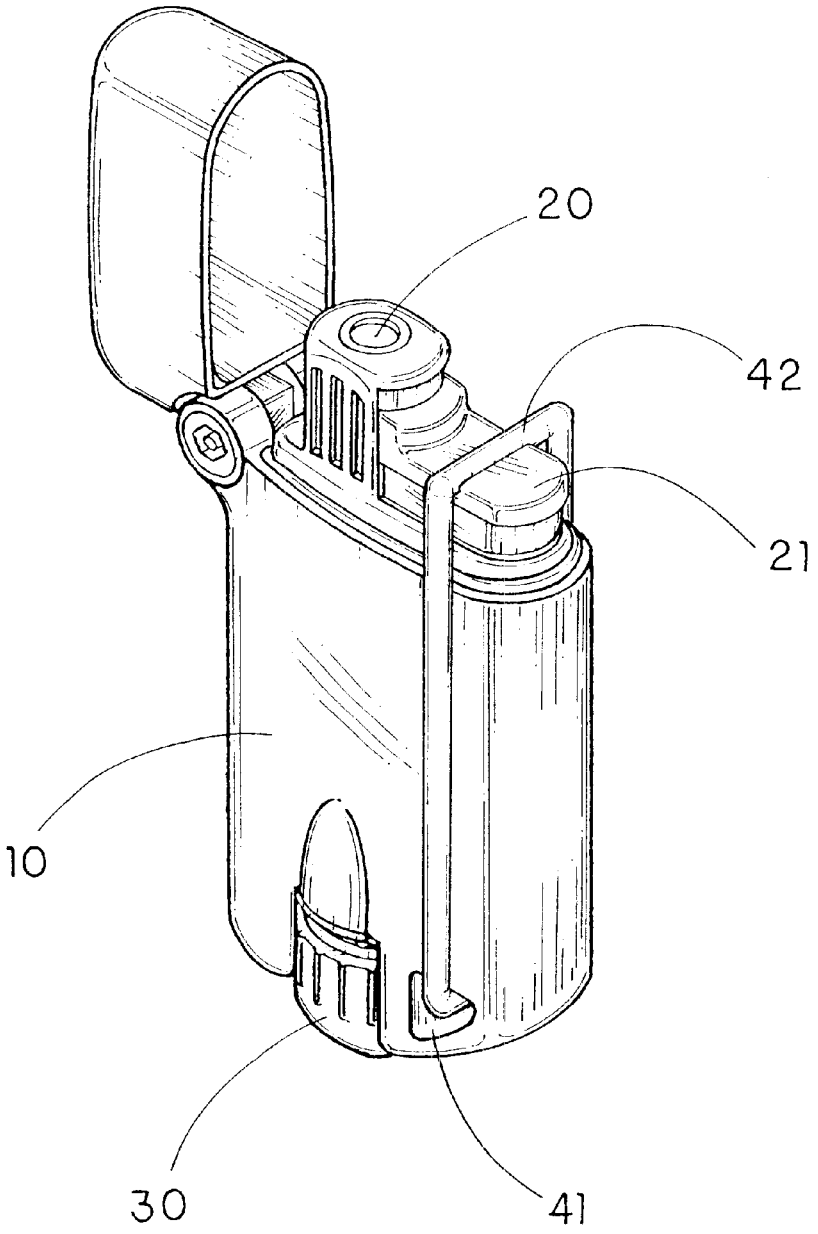
FIG. 3 is a perspective view of the adjustable jet flame utility lighter according to the above preferred embodiment of the present invention, illustrating the pusher button being held by the holding means.

Referring to FIGS. 1 to 3 of the drawings, an adjustable jet flame utility lighter 1 according to a preferred embodiment of the present invention is illustrated. The adjustable jet flame utility lighter 1, such as a standard piezoelectric lighter, comprises a casing 10 having a liquefied gas storage 11.

A gas emitting nozzle 20 is appearing at a ceiling 101 of the casing 10 and communicating with the liquefied gas storage 11 in the casing 10. A windshield 14 is slidably mounted on the ceiling 101 of the casing 10 and encircling the gas emitting nozzle 20.

A piezoelectric unit 12, which is disposed in the casing 10 for generating piezoelectricity, comprises a movable operating part 121 extended upwardly and an igniting tip 13 extended adjacent to the gas emitting nozzle 20, wherein when the movable operating part 121 is depressed downwardly, the ignition tip 13 generates sparks to ignite the gas emitted from the gas emitting nozzle 20 at the same time.

A pusher button 21 is slidably mounted on the ceiling 101 of the casing 10 in a vertically movable manner wherein the pusher button 21 is attached to a top of the piezoelectric unit 12 and arranged in such a manner that when the pusher button 21 is depressed downwardly, the movable operating part 121 of the piezoelectric unit 12 is depressed to ignite the lighter 1.

The adjustable jet flame utility lighter 1 further comprises a hand operative adjustable button 30 and a holding means 40.

The hand operative adjustable button 30 is disposed in the casing 10 for controlling the flow of gas through the gas emitting nozzle 20. The hand operative adjustable button 30 is an enlarged button of a gas regulator of a conventional lighter in such a manner the user is easy to control the gas flow by means of turning the hand operative adjustable button 30. Thus, the hand operative adjustable button 30 has a diameter at least the same length as a width of the casing 10 such that the gas flow can be adjusted precisely because the user is easily to turn hand operative adjustable button 30 with a bigger size thereof.

The hand operative adjustable button 30 is mounted at a bottom of the casing 10 coaxially aligning with the gas emitting nozzle 20 wherein the hand operative adjustable button 30 is arranged to regulate a valve of the gas emitting nozzle 20 in such a manner when the hand operative adjustable button 30 is rotated to decrease the flow of the gas, the size of the flame of the lighter 1 becomes smaller. On the other hand, when the hand operative adjustable button 30 is opposedly rotated to increase the flow of the gas, the size of the torching flame of the lighter 1 becomes larger. In other words, the operative adjustable button 30 can adjust the size of the torching flame of the lighter 1 during ignition position, so as to give conveniently for the user to control the flow of the gas especially when the user is doing the soldering work.

The holding means 40 mounted on the casing 10 for holding the depressed pusher button 21 in such a manner the jet flame utility lighter 1 is kept in an ignition position. As it is mentioned above, when the pusher button 21 is depressed downwardly by a pushing force applied by the user's thumb, the piezoelectric unit 12 is driven to compress in order to ignite the lighter, which is the ignition position of the lighter. The holding means 40 is adapted for holding the depressed pusher button 21 instead of the user's thumb such that the user's thumb does not have to keep pressing the pusher button 21 in order to retain the lighter 1 in the ignition position.

The holding means 40 comprises a guiding through channel 41 provided at the bottom of the casing 10 aligning with the pusher button 21 and a holding element 42 movably held with the guiding through channel 41 in such a manner the holding element 42 is arranged to mount on a ceiling 211 of the depressed pusher button 21, so as to retain the lighter 1 in the ignition position. In order to hold the holding element 42 on the pusher button 21 in position, the holding means 40 further comprises a holding groove 43 provided on the ceiling 211 of the pusher button 21 such that when the holding element 42 is fitly mounted on the pusher button 21, the holding element 42 is disposed in the holding groove 43, so as to securely holding the pusher button 21 in the ignition position.

The holding element 42, according to the preferably embodiment, is an elongated ring holder 421 wherein one end thereof is movably threaded on the guiding through channel 41 while another end of the ring holder 421 is adapted to be slidably flipped on the pusher button 21 along the holding groove 43. The ring holder 421 has a length slightly longer than a distance between the ceiling 211 of the depressed pusher button 21 and the guiding through channel 41 such that the ring holder 421 is flipped over to mount on the ceiling of the pusher button 21 when the pusher button 21 is pushed downwardly.

In order to operate the adjustable jet flame utility lighter 1, such as the conventional lighter, a pushing force must be downwardly applied on the pusher button 21 by the user's thumb in order to compress the piezoelectric unit 12 to ignite the lighter 1. At the same time when the pusher button 21 is depressed, the ring holder 421 of the holding element 42 is flipped over around the guiding through channel 41, so as to slidably mount on the ceiling 211 of the depressed pusher button 22 along the holding groove 43 provided thereon. In such arrangement, the pusher button 21 is held at the depression position so as to retain the lighter 1 in the ignition position. It is worth to mention that during the ignition position of the lighter 1, the user is able to control the flow of gas by the hand operative adjustable button 30 so as to adjust the size of the torching flame of the lighter 1. So, the adjustable jet flame utility lighter 1 of the present invention can be a tool for doing the minor soldering work since the torching flame of the lighter 1 can be directly pointed to a work piece while the user does not have to hold the pusher button 21 with his or her thumb, which is safe and convenient for the user.

Figure 4:
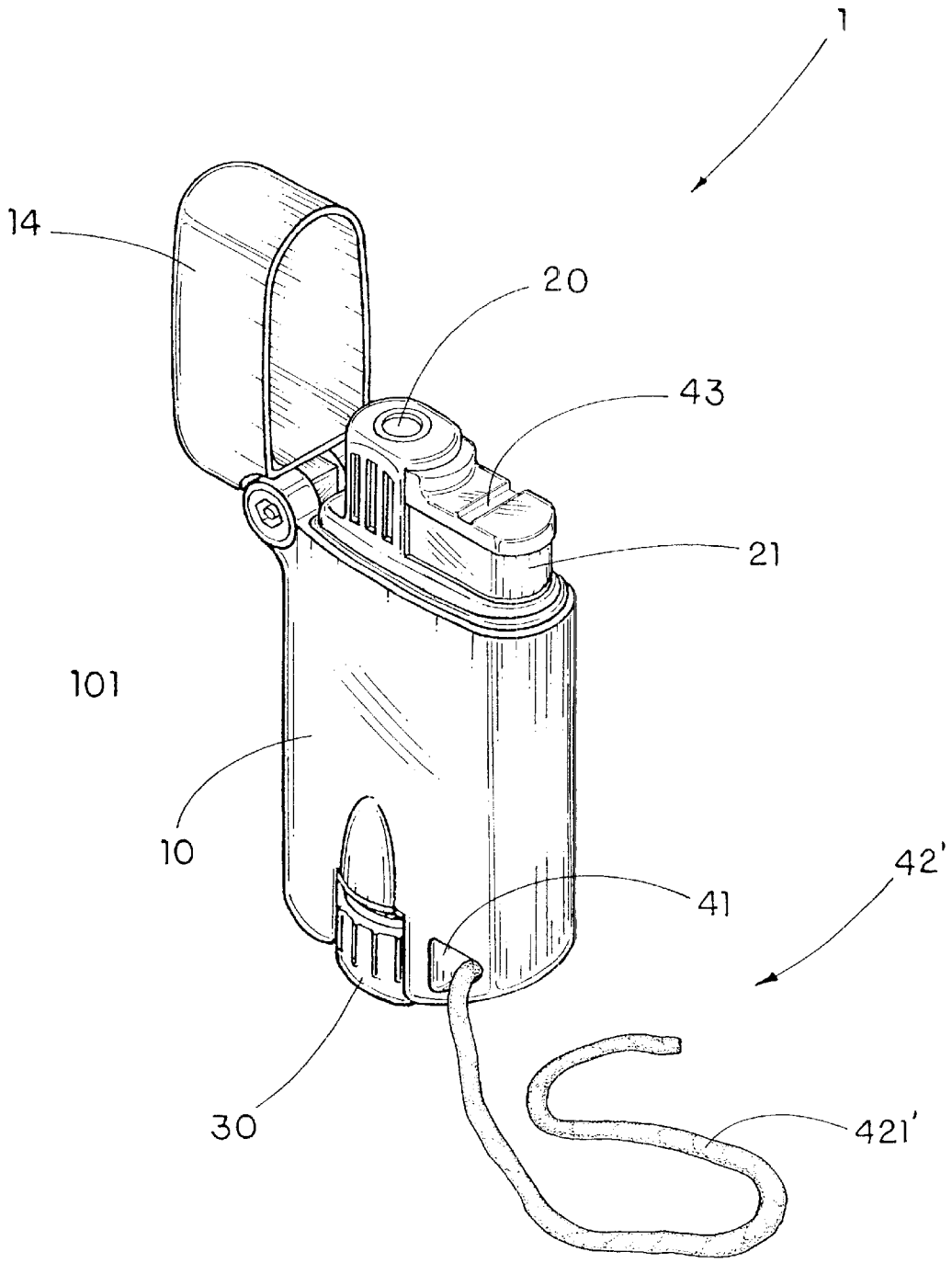
FIG. 4 illustrates an alternative mode of the holding means of the adjustable jet flame utility lighter according to the above preferred embodiment of the present invention.

FIG. 4 illustrates an alternative mode of the holding element 42' wherein the holding element 42' is an elastic strip 421' wherein one end thereof is firmly tightened at the guiding through channel 41 in such a manner when the pusher button 21 is. depressed downwardly, the elastic strip 421' is pulled to encirclingly mount on the ceiling 211 of the pusher button 21, so as to hold the pusher button 21 in the ignition position.

What is claimed is:

1. An adjustable jet flame utility lighter, comprising:

a casing having a liquefied gas storage, a gas emitting nozzle appearing at a ceiling of said casing and communicating with said liquefied gas storage in said casing, a piezoelectric unit, which is disposed in said casing for generating piezoelectricity, comprising an igniting tip extended adjacent to said gas emitting nozzle;

a pusher button slidably mounted on said ceiling of said casing in a vertically movable manner, wherein when said pusher button is depressed downwards to a depression position, said pusher button both opens a valve of said gas emitting nozzle to provide a flow of gas emitted from said emitting nozzle and operates said piezoelectric unit to generate sparks to ignite said flow of gas emitted from said gas emitting nozzle to produce a jet flame at said emitting nozzle;

a holding means, mounted on the casing, for holding said pusher button at said depression position so as to retain said adjustable jet flame utility lighter in an ignition position to continuously produce said jet flame; and a hand operative adjustable button rotatably mounted on said casing for controlling said flow of gas through said gas emitting nozzle, wherein said hand operative adjustable button is an enlarged button having a diameter equal to or larger than a width of said casing, wherein by retaining said depression position of said adjustable jet flame utility lighter with said holding means, a size of said jet flame is able to be adjusted by controlling said flow of said gas by turning said hand operative adjustable button by hand while observing a change of size of said jet flame during operation.

2. An adjustable jet flame utility lighter, as recited in claim 1, said hand operative adjustable button is mounted at a bottom of said casing coaxially aligning with said gas emitting nozzle.

3. An adjustable jet flame utility lighter, as recited in claim 1, wherein said holding means comprises a guiding through channel provided at a bottom of said casing aligning with said pusher button and a holding element movably held with said guiding through channel in such a manner said holding element is arranged to mount on a ceiling of said depressed pusher button, so as to retain said lighter in said ignition position.

4. An adjustable jet flame utility lighter, as recited in claim 2, wherein said holding means comprises a guiding through channel provided at said bottom of said casing aligning with said pusher button and a holding element movably held with said guiding through channel in such a manner said holding element is arranged to mount on a ceiling of said depressed pusher button, so as to retain said lighter in said ignition position.

5. An adjustable jet flame utility lighter, as recited in claim 3, wherein said holding means further comprises a holding groove provided on said ceiling of said pusher button for holding said holding element on said pusher button in position.

6. An adjustable jet flame utility lighter, as recited in claim 4, wherein said holding means further comprises a holding groove provided on said ceiling of said pusher button for holding said holding element on said pusher button in position.

7. An adjustable jet flame utility lighter, as recited in claim 5, wherein said holding means is an elongated ring holder wherein one end thereof is movably threaded on said guiding through channel while another end of said ring holder is adapted to be slidably flipped on said pusher button.

8. An adjustable jet flame utility lighter, as recited in claim 6, wherein said holding means is an elongated ring holder wherein one end thereof is movably threaded on said guiding through channel while another end of said ring holder is adapted to be slidably flipped on said pusher button.

9. An adjustable jet flame utility lighter, as recited in claim 7, wherein said ring holder has a length slightly longer than a distance between said guiding through channel and said ceiling of said pusher button when it is downwardly depressed.

10. An adjustable jet flame utility lighter, as recited in claim 8, wherein said ring holder has a length slightly longer than a distance between said guiding through channel and said ceiling of said pusher button when it is downwardly depressed.

11. An adjustable jet flame utility lighter, as recited in claim 5, wherein said holding element is an elastic strip wherein one end thereof is firmly tightened at said guiding through channel in such a manner when said pusher button is depressed downwardly, said elastic strip is pulled to encirclingly mount on said ceiling of said pusher button.

12. An adjustable jet flame utility lighter, as recited in claim 6, wherein said holding element is an elastic strip wherein one end thereof is firmly tightened at said guiding through channel in such a manner when said pusher button is depressed downwardly, said elastic strip is pulled to encirclingly mount on said ceiling of said pusher button.

* * * * *